United States Patent [19]

Larive

[11] 4,183,724

[45] Jan. 15, 1980

[54] CONDUIT MAKING APPARATUS

[76] Inventor: David Larive, 7707 Bryonwood, Houston, Tex. 77055

[21] Appl. No.: 660,603

[22] Filed: Oct. 18, 1976

[51] Int. Cl.[2] ..... B28B 21/44; B28B 21/56

[52] U.S. Cl. ..... 425/62; 425/64; 425/112; 425/224; 425/404

[58] Field of Search ..... 425/59, 62–65, 425/112, 122, 224, 404; 29/460, 527.4; 72/135, 142, 148

[56] References Cited

U.S. PATENT DOCUMENTS

| | | | |
|---|---|---|---|
| 2,605,202 | 7/1952 | Reynolds | 29/460 |
| 2,998,339 | 8/1961 | Barnes et al. | 29/460 |
| 3,470,051 | 9/1969 | Meyer | 425/404 |
| 3,497,413 | 2/1970 | Ullman et al. | 425/112 |
| 3,520,749 | 7/1970 | Rubenstein | 425/404 |
| 3,526,692 | 9/1970 | Onaka | 425/112 |

*Primary Examiner*—John McQuade
*Attorney, Agent, or Firm*—Michael L. Parks

[57] ABSTRACT

This invention relates to an apparatus for making concrete conduit.

The apparatus of this invention for making concrete conduit comprises a base and a transmission mounted on the base with a power unit drivingly connected to the transmission; a form connected to the transmission for shaping a conduit mat of material; feeders drivingly connected to the transmission for applying material over the form to form a conduit mat of the material; advancing apparatus to move the formed conduit mat from the form; fastener apparatus for binding the layers of conduit mat together as the conduit mat is advanced; injection apparatus connected to the base for injecting concrete on the conduit mat; trowel means adjacent the inside and the outside of the conduit mat for working the concrete into the conduit mat and smoothing both the inside and the outside surfaces of the conduit mat; and means for controlling the curing of the concrete conduit thus formed. The apparatus also is provided with cutter apparatus for cutting various desired lengths of concrete conduit. Also the apparatus of this invention is adaptable to being mounted on a mobile base which lays the concrete conduit as it is formed.

13 Claims, 11 Drawing Figures

CONDUIT MAKING APPARATUS

SUMMARY OF THE INVENTION

This invention relates to an apparatus for making concrete conduit.

The apparatus of this invention provides a base, a transmission connected to the base and a power source drivingly connected to the transmission. The base of this invention is adaptable to being mounted for making the apparatus mobile. Connected to the transmission is a form for forming the shape of the concrete conduit to be made. Drivingly connected to the transmission is a feeder for applying material over the form to form a conduit mat of the material. An advancer is drivingly connected to the transmission for advancing the conduit mat off the form to a fastener means for fastening the conduit mat together. The conduit mat is cut by a cutter into desired lengths and advanced to a concrete injector for applying concrete on the conduit mat. Troweling means are then provided for working and smoothing the concreted conduit both from the inside and the outside to form a concrete conduit. The concreted conduit is then cured to form a finished concreted conduit.

BACKGROUND OF THE INVENTION

The art of making concrete pipe and conduit is old and much prior art exists; however, the prior art pipe and conduit making apparatus and methods have many deficiencies. For example, the prior art of Rubenstein, U.S. Pat. No. 3,520,749 makes concrete pipe by the method of extruding concrete about a plastic liner, thus the plastic liner becomes part of the pipe. In these days of high-priced petroleum based products, the plastic for such liners is expensive which makes pipe of this invention very expensive. Also the art of Rubenstein requires an extrusion process to bond the concrete with the plastic pipe liner. Also the concrete used in Rubenstein has other binders of polymeric resins mixed with the concrete to aid in bonding the concrete to the plastic liner. Another problem with Rubenstein, in addition to increased costs of the plastic liner, is that he requires expensive dies for the extrusion process and such dies are subjected to wear from the grit of the concrete. Also the apparatus of Rubenstein has many problems with controlling the resins so that the resins do not prematurely set-up or fail to set-up, either of which prevents the concrete from bonding to the plastic liner. Further the pipe produced by this invention is a sandwich type pipe which when put in the ground is subject to failure at the interface of the two materials, to-wit: The bonding point of the concrete and the plastic liner thus creates points of weakness in the pipe which make it subject to premature failure.

Other prior art concrete pipe which comes in relatively short links and thus require many joints in a pipe line, have the problem of hydraulic infiltration because the joints between each section are difficult to seal and water seeps into the pipeline. This infiltration problem is important when the pipe is sewer pipe because the infiltration into the sewer pipe causes hydraulic overloading of sewer plants which cause pollution when the sewer plants discharge inadequately treated waste.

Another problem with the prior art concrete pipe is that it requires many handlings prior to being layed in the ground which drives up the cost of laying this pipe and also provides the opportunity for breakage.

Also as much of the concrete pipe used today is made by being poured into forms, a plant must have a great inventory of forms because the pipe must remain in the form for several days. This long length of time thus requires large numbers of forms which are tied up for days at a time. It will be readily understood that the larger the inventory of forms the more costly the process for making the concrete pipe.

Further the prior art concrete pipe usually requires high cost reinforcing rod, re-bar, or heavy wire for its structural integrity. Also the prior art concrete pipe requires generally great thickness to obtain its strength, and thus is more expensive.

The present invention relates to an improved apparatus for making concrete conduit and concrete pipe. This invention provides a means for using low grade wire netting like "chicken wire", welded mesh, vegetable fiber netting, or other fibers, to form a conduit mat and may use heavy size strand wire or fiber for some application. After the mat is formed, then concrete is worked therein and over the conduit mat to form a strong concrete conduit of relatively thin walls and exceptional strength and resilient properties.

Also the apparatus of this invention reduces the number of joints required in laying the conduit because the apparatus of this invention can make concrete conduit in a continuous piece of any length. By having fewer joints, the cost of laying such pipe lines are reduced and the amount of hydraulic infiltration is greatly reduced.

Also the cost of making concrete conduit with this present invention is greatly reduced because of the simplicity of manufacture and the few number of operators required to be present during its manufacture.

Another object of this invention is that no liner is required in its manufacture. Instead the troweling means connected to the transmission means works the inside surface with concrete while the conduit is continually advanced. Thus the concrete conduit of this invention has a relatively smooth concrete surface both inside and outside, without any need for plastic liners.

Another object of this invention is to make a homogenous concrete conduit and eliminate the sandwiching of layers of different material together.

Also another feature of this invention is that no extrusion is used in working the concrete, which eliminates the need for expensive dies.

Also no externally applied heat is needed to form this concrete conduit into a cured finish product.

A further object of this invention is to provide a readily changeable form size which allows the apparatus of this invention to make various pipe sizes in unlimited quantities of any given size by needing only one form for each size.

Another object of this invention is to reduce the handling of finished pipe. In this invention the only handling is of the bulk or raw materials when the pipe is made on the site where the pipe is to be layed.

These and other objects will be apparent from the drawings and the following descriptions, the drawings which are for illustrations of some embodiments of this invention.

Figure 1:
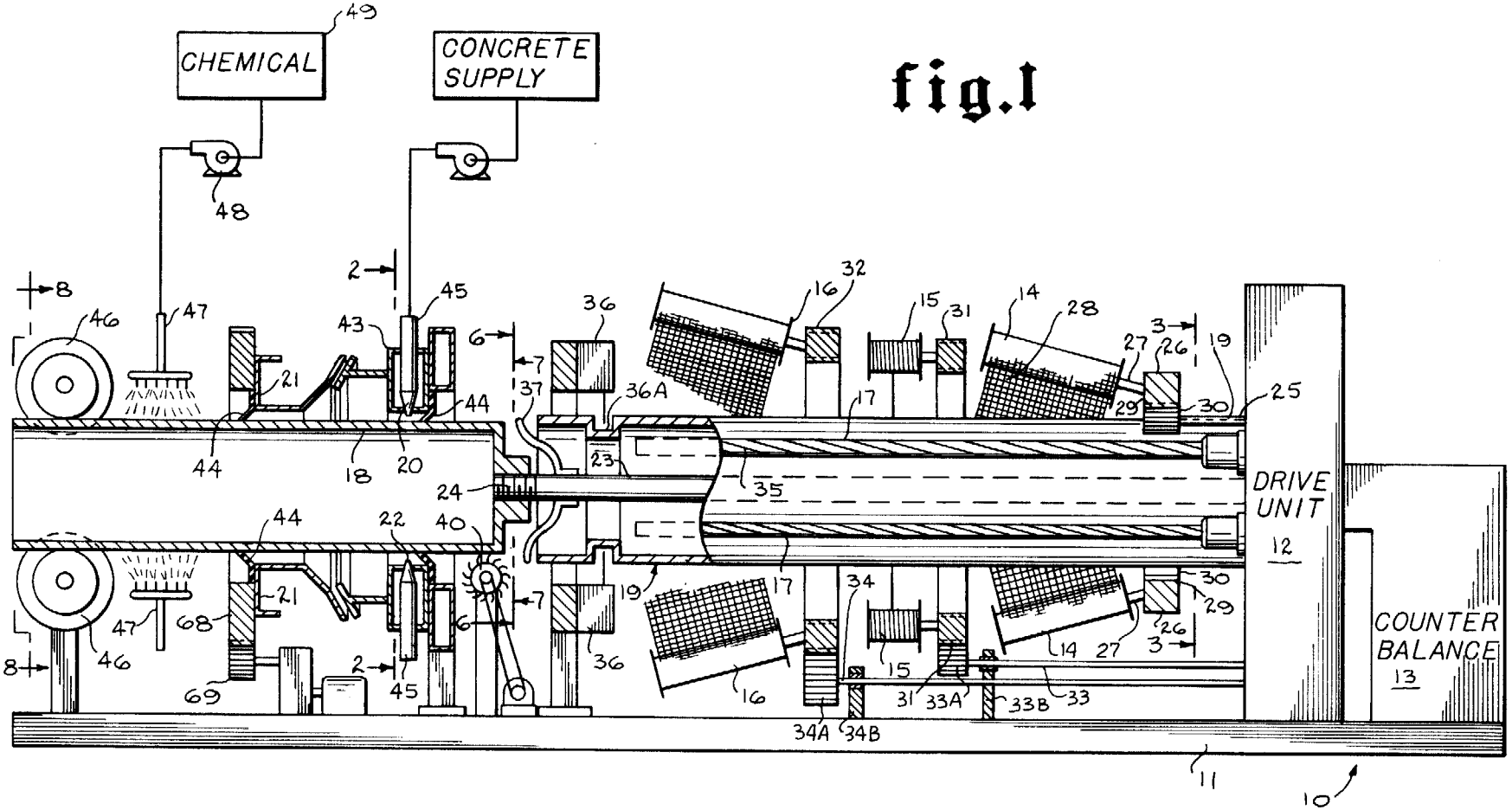
FIG. 1 is an elevation view in partial cross-section of the pipe-making apparatus of this invention.

Referring initially to FIG. 1 of the drawings, the apparatus of this invention is generally referred to at 10. In this embodiment a base 11 is provided for mounting a transmission 12 thereon.

Drivingly connected to the transmission 12 is a power unit 13, which provides the driving power for the transmission 12. The transmission 12 is drivingly connected to feeders 14, 15, 16, advancers 17, and first trowel 18 for their respective movement by the transmission 12. Connected to the housing of the transmission 12 is a fixed form 19 for shaping a conduit mat of material. Located in recesses on the form are the advancers 17 which are drivingly connected to the transmission 12 for advancing the conduit mat off form 19. The feeders 14, 15, 16 are located proximate to the form 19 for feeding material onto the form 19 which forms the conduit mat as the advancers 17 advance the formed conduit mat from the form 19. Adjacent the form 19 is a first trowel 18 for receiving the conduit mat of material as it is advanced off form 19. In the region proximate of the first trowel 18 concrete is applied to the conduit mat by injectors 20. A smoothing head 21 and second trowel 22 finishes the outer surface of the concreted conduit as it is passed thereby.

The first trowel 18 is rotatively driven by the transmission 12 for working the inside surface of the concreted conduit mat as the concrete is applied. The rotating first trowel 18 is drivingly connected to the transmission 12 by a drive shaft 23 to provide the power to rotate the first trowel 18. The first trowel 18 is connected to the drive shaft 23 by a threaded connector 24. This threaded connector 24 thus allows the first trowel 18 to be changed from one size to various sizes of first trowel 18 to be used with various corresponding sizes of form 19, which can be changed by disconnection from transmission 12 and reconnecting another size of form 19 to the transmission 12.

More specifically, it should be understood in one embodiment of this invention that the power unit 13 is drivingly connected to the transmission 12 for providing a counter balancing lever arm for aiding in balancing and stabilizing other apparatus which are drivingly connected to the transmission 12 and suspended from the side of the transmission 12 opposite the power unit 13. In this embodiment, the transmission 12 is a series of transmission gears (not shown) for directing rotation to other apparatus of this invention which are drivingly engaged with the gears of the transmission 12.

Figure 4:
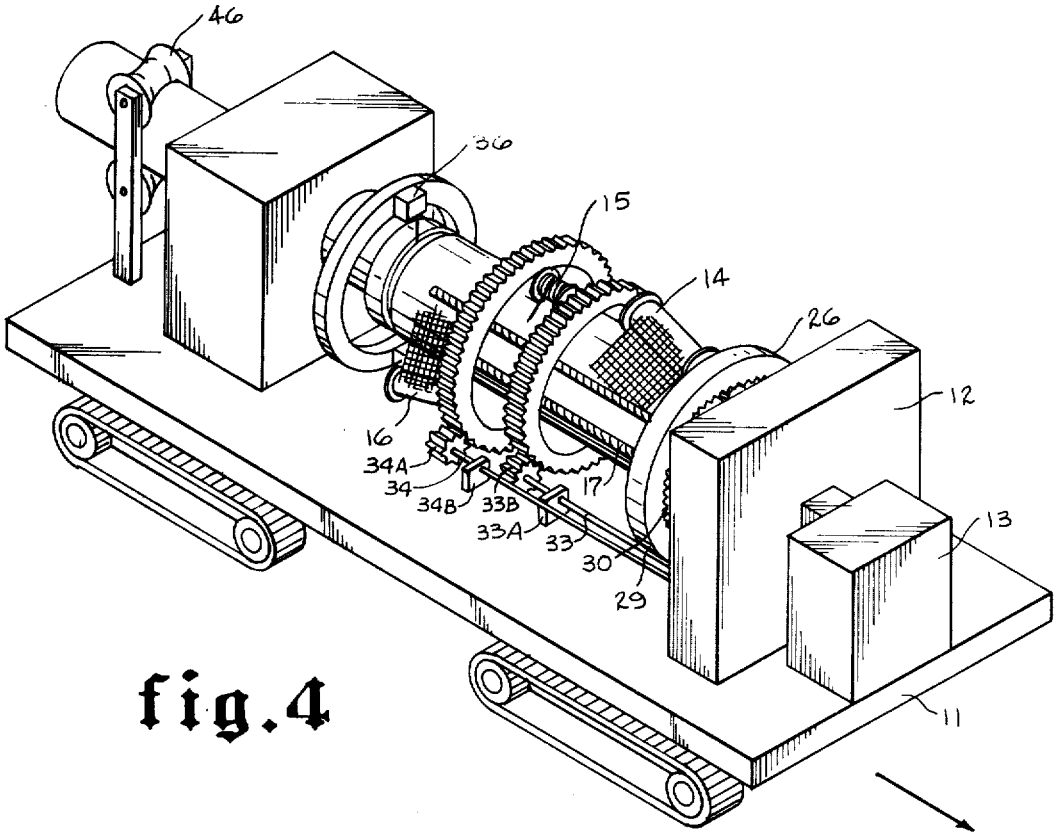
FIG. 4 is a view of the apparatus of this invention mounted for movement.

A gear shaft 25 is drivingly engaged with the transmission 12 for rotatively driving a gear ring 26. The gear ring 26 has mounted therefrom a feeder shaft 27 onto which is placed a feeder 14 for the feeding off the material 28 to the form 19. The feeder shaft 27 in this embodiment is mounted on the gear ring 26 for the feeder 14 to feed the material of the feeder 14 onto the form 19 on the bias. As can be seen in FIG. 4 and FIG. 1, the gear ring 26 is a circular ring 29 having gear teeth 30 on the inside surface of the ring for rotating engagement with the gear shaft 25. It should be understood that the material useable in this invention is preferably wire mesh, "chicken wire" and other relatively flexible mesh materials; however other materials such as vegetable netting, refined organic nettings such as nylon and inorganic netting may also be used and still be in the scope of this invention. Also the feeders 14 are provided with tensioning means such as springs (not shown) to cause the material 28 to be fed off feeders 14 under tension. As the material 28 is fed off the feeders 14 under tension the material 28 is wrapped around the form 19 as the feeder 14 and gear ring 26 are moved circumferencially about the form 19. Thus, the material 28 is unwound off the feeder 14 and over the form 19 under tension sufficient to conform the material 28 to the shape of the form 19.

Figure 9:
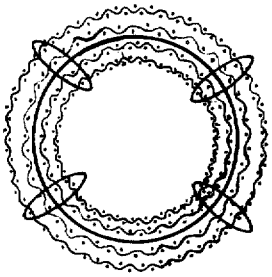
FIG. 9 is a cross-section of the pipe made by the apparatus of this invention using mesh and wire.
Figure 10:
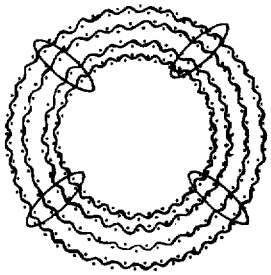
FIG. 10 is a cross-section of the pipe made by the apparatus of this invention using mesh.

Additional feeders 15 and 16 are also provided for applying multiple layers of material on the form 19 to form multiple layers of material as shown in FIG. 10. Also these feeders 15 and 16 may feed different materials to achieve different properties in the finished pipe. For example, heavy wire may be fed off feeder 15 and mesh off feeder 14 and 16 to produce a spiral wrap of heavy wire between mesh layers for improved strength of the concreted conduit as shown in FIG. 9. The Feeders 15 and 16 are driven in a like manner as the feeder 14 by respective gear ring 31 and 32 which are drivingly engaged with gear shafts 33 and 34 connected to transmission 12, except that the gear 33A and 34A and gear shafts 33 and 34 are drivingly connected to transmission 12 in a manner which does not interfere with the applying of material on form 19. In one such embodiment gear rings 31 and 32 are supported on gears 33A and 34A by gears 33A and 34A being on supports 33B and 34B mounted on base 11. These feeders 15 and 16 also unwind the material 28 over the form 19 under tension. The tension applied on the material as it is unwound over the forms causes the wire material to adapt to the shape of the form 19.

As all feeders 14, 15 and 16 are being unwound over the form 19, advancer 17 moves the material which has been formed into a conduit mat over the form 19 off the form 19.

Figure 3:
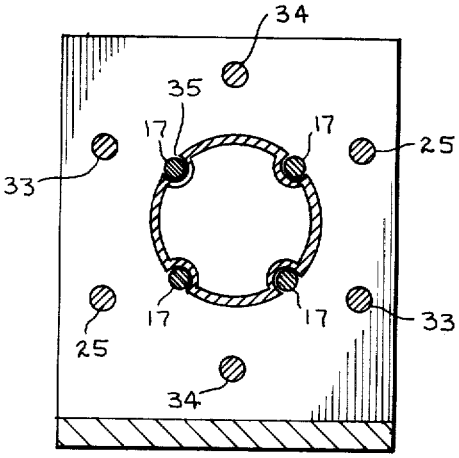
FIG. 3 is a cross-section view taken through lines 3—3 of FIG. 1 showing the form and advancing mechanism of one embodiment of this invention.
Figure 8:
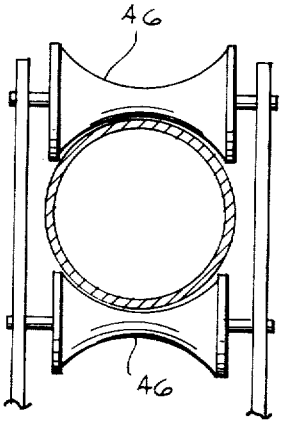
FIG. 8 is a cross-section view taken through lines 8—8 of FIG. 1 showing the advancer rollers.

The advancer 17 can best be seen as shown in FIG. 3 where in this embodiment there are four separate advancers 17 shown. The advancers 17 are mounted within slots or grooves on the form 19 with their outside surface extending above the outside surface of the form 19. The surface of the advancers provided above the outside surface of form 19 is grooved or threaded to form a worm gear 35. The material 28 is pressed over worm gear surfaces 5 and against the worm gear surfaces 35 as it is fed on the form 19 and advancers 17. As can be seen in FIG. 1, when the worm gear surfaces 35 of advancers are drivingly rotated by the transmission 12 to which they are drivingly connected, the worm gear surfaces 35 will engage the conduit mat and continuously advance the conduit mat off form 19.

Figure 6:
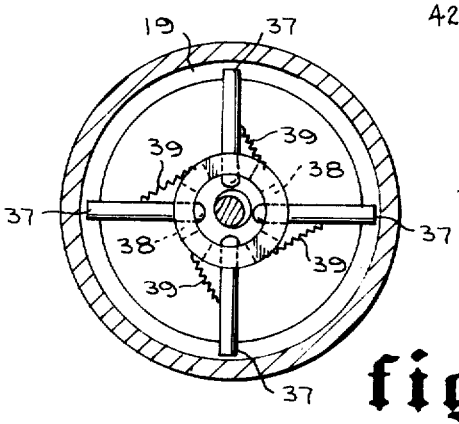
FIG. 6 is a cross-section view taken along lines 6—6 of FIG. 1 showing the cutter of one embodiment.

As the conduit mat is advanced off form 19, a fastener 36 of a conventional type such as a "hog ringer" stapler is provided to fasten the conduit mat layers together as the conduit mat is being advanced off the form 19. The fastener 36 provides for the insertion of a fastener such as a staple, through the conduit mat and about the conduit mat at the fastener 36 to fasten the mat together. It can be seen in FIG. 1 that a recessed surface 36 (a) is provided to allow the fastener 36 to pass a fastener through the conduit mat and be closed about the conduit mat and thus bind the conduit mat together. Also, in some embodiments, the bottom of the recessed surface 36 (a) takes the form of an anvil which closes the fastener or staple about the mat as the fastener 36 drives the staple through the conduit mat. This fastener serves to strengthen the mat, and to hold it together in a uniform thickness and shape after it leaves the form 19. In some applications of materials, the fastener 36 is not used because it is not necessary when the materials have properties which keep their shape without fastening. Proximate the end of the form 19 are cutters 37 for cutting the conduit mat into desired lengths. The cutters 37 in one embodiment are mounted about the rotating drive shaft 23 for engagement thereon upon command from an appropriate control. In this embodiment, when commanded, the cutters 37 engage the rotating drive shaft and the cutters 37 are moved from a first position through 90° to a second position while they are advanced at the same rate as the advancing conduit mat and then the cutters 37 are returned to their first position. The cutters 37 are driven from a first position to the second position by a slotted cam 38 and a return spring 39 as shown in FIG. 6. The cutters 37 of this embodiment may be cutting torches, abrasive wheels, etc., for effecting a relative smooth and even cut through the conduit mat of material. It should be understood by those skilled in the art that any cutter may be used which would produce a smooth cut while the conduit mat is being advanced. Further in some applications, it may be desirable to stop the advancement of the mat and make a cut through the conduit mat and this type cutting would not depart from the teaching of this invention.

Adjacent to the point of discharge from form 19, there is provided a first trowel 18 which has an outside diameter slightly smaller than form 19, onto which the conduit mat is advanced. The first trowel 18 is connected to the transmission 12 by a shaft 23 which is drivingly connected to the transmission 12. The transmission drives the shaft 23 and first trowel 18 in rotary motion as the conduit mat is fed onto the first trowel 18.

As the conduit mat is fed along the first trowel 18, centering rollers 40 are located about the lower portion of the first trowel 18 for receiving the conduit mat and raising it sufficiently to approximately center the conduit about the first trowel 18. In one embodiment, a power drive belt 41 is also provided to the centering rollers 40 for imparting additional advancing forces to the conduit mat. Centering rollers 40 may also be provided with spikes 42 set for engagement with and advancement of the conduit mat.

Further as the conduit mat is fed along the first trowel 18, a ring 43 is provided about the first trowel 18 into which is mounted concrete injectors 20 for applying concrete onto the conduit mat and first trowel 18 as the mat is passed along the first trowel 18. Just prior to the point of application of concrete to the conduit mat, resilient seal 44 is provided about the first trowel 18 to prevent concrete from escaping the concreting zone. Also connected to the ring 43 between the concrete injectors 20 are second trowels 22 having concrete vibrators 45 connected to the second trowel 22. A better view of ring 43 can be seen in FIG. 2.

Figure 2:
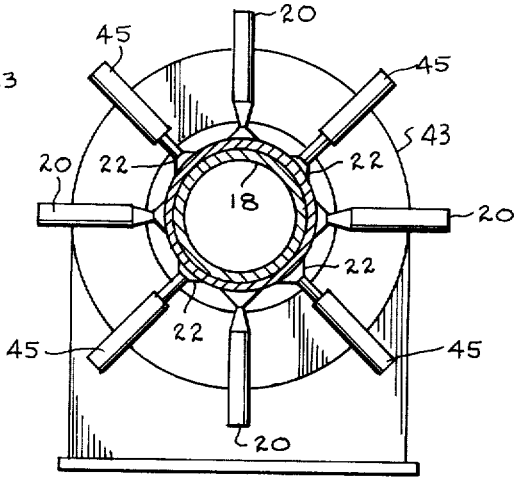
FIG. 2 is a cross-section view taken through lines 2—2 of FIG. 1 showing the vibrator head and injector heads of the apparatus of this invention.
Figure 7:
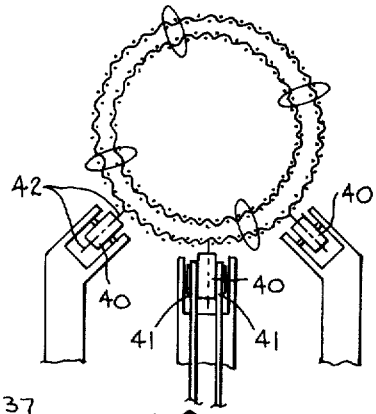
FIG. 7 is a cross-section view taken through lines 7—7 of FIG. 1 showing the mat centering rollers.

In FIG. 2 it can be seen that the concreted conduit mat is advanced through the ring 43 which substantially encircles the first trowel 18. Just prior to the conduit mat being passed to the ring 43, centering wheels 40 shown in FIG. 7 raise the conduit mat to position it substantially in the center of the first trowel 18. The centering wheels 40 can also be supplied with power drive 41 from transmission 12 if needed to aid the advancement of the conduit mat through ring 43. As the conduit mat is advanced, a concrete injector 20 drives the concrete into and through the conduit mat. Dispersed between the injector 20 are second trowels 22 which have the concrete vibrator 45 connected thereto for working the concrete with sound waves to form a concreted conduit mat which is substantially homogenous and without air pockets. As the first trowel 18 is being rotated by the shaft 23 it is continuously smoothing the inside surfaces of the concreted conduit mat. Before passing off the first trowel 18, the concrete conduit mat passes through smoothing heads 21 and resilient seals 44 which are mounted about the outside surface of the concreted conduit for working the cement along the outside diameter to provide a finished surface. In some applications, the smoothing heads 21 are rotated about said concreted conduit in a direction opposite to the direction of rotation of said first trowel 18 by drive gears 69 which rotate smoothing ring 68 and sometimes the direction of rotation may be alternated first in one direction and then the other direction.

The concreted conduit can be coated to control the curing rate after passing through the resilient seals 44. The coating in one embodiment is sprayed on by nozzles 47 which are connected to a pump 48 and chemical supply tank 49. In another embodiment a thin film is sprayed or blown about the outside surface to control the curing rate. Also paper or other material may be wrapped about the outside to control the curing rate.

To aid in the removal of the concreted conduit, concaved rollers 46 are provided to receive and remove the concreted conduit without damaging the formed shape.

In at least one embodiment the apparatus of this invention can be mounted on tracted wheels for movement as the apparatus is forming the pipe and simultaneously laying it as it is made. It should also be understood that the pipe making apparatus of this invention may be located within a conventional factory and used to manufacture pipe from a fixed location.

Figure 11:
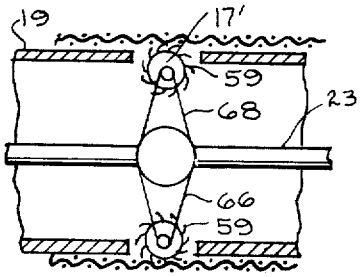
FIG. 11 is a cross-section of another embodiment of an advancer for advancing the mat off the form.

Also in one embodiment the advancer 17 as shown in FIG. 11 may be spiked wheels 59 for imparting advancing movement to the conduit mat as it is formed on form 19. In the advancer 17' the power for driving the spiked wheels 59 is from driving engagement of belt 66 with the drive shaft 23.

Figure 5:
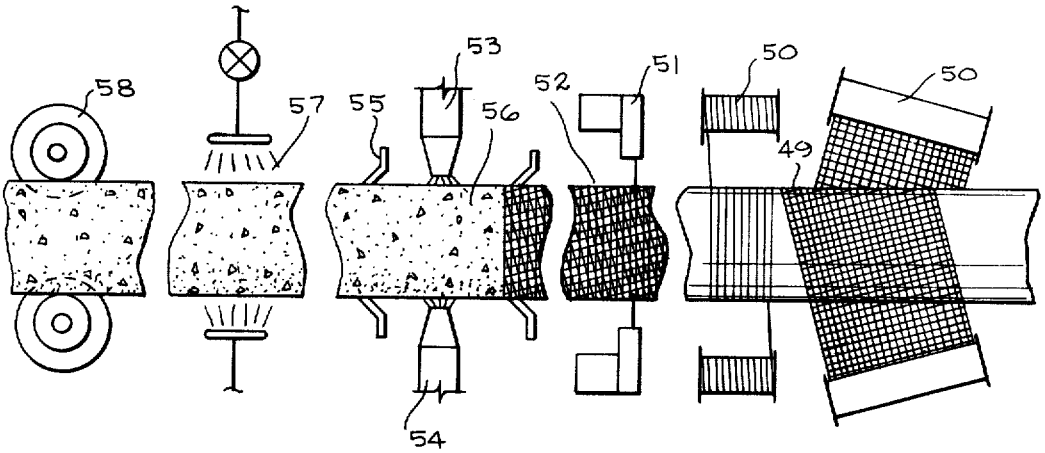
FIG. 5 is a diagramatic drawing of the method of operating the apparatus of this invention.

The operation of this invention shown in FIG. 5 which shows the steps of forming a conduit mat in a mat forming zone 49. The step of forming this mat comprises directing the material to be used in the forming of the mat from feeding zones 50 into the mat forming zone 49 by the feeding zone 50 being rotated circumferentially about the mat forming zone 49 and allowing the material to be unrolled from the feeding zone 50 under tension sufficient to cause the material to conform to the shape of the mat forming zone 49.

In this step of the operation it has been found advantageous to feed the mat forming material into the mat forming zone 49 on the bias and further it has been found that such materials as square welded mesh, chicken wire, and other low grade material of a relatively tight knit weave would be considered as preferred materials. Also in some applications, a single strand or strands of thicker wire or other material may be placed between the layers of mesh; so that the mesh forms the inner and outter surfaces of the conduit. However, it has also been found that other mesh type materials such as organic and non-organic fibers may be used to form concreted conduit of this invention.

As the conduit mat is formed, it is then advanced from the mat forming zone 49 to fastening zone 51 for fastening the layers of the conduit mat together. As the conduit mat is further advanced, the conduit mat is cut into desired lengths in the cutting zone 52.

After cutting the conduit mat it is advanced to a concreting zone 53 for applying concrete on the formed mat. As the concreted mat is further advanced over the concreting zone 53, smoothing of the internal surfaces of the concreted mat are accomplished by a rotating trowel in a first trowelling zone 56 inside the concreted conduit as the concreted conduit is advanced over the concreting zone 53. The external surface of the concrete conduit is smoothed by vibrations within the second trowelling zone 54 and passing smoothing edge 55 adjacent to the concreted pipe. It has also been found on some occasions that the addition of water and/or other fluids can provide lubrication between the smoothing surfaces and the pipe as the concreted conduit is advanced. Curing the concreted conduit mat is accomplished by controlling the drying rate by coating the outside of said concreted conduit to control the moisture loss in a curing zone 57. This coating may be wrapped paper, fabric or other coatings or film to control the drying rate. The finished product is then taken off said concreted conduit by take off zone roller 58.

It should be understood by those skilled in the art that the smoothness of the product depends on the consistency of the concrete being used and its drying qualities and its viscosity or fluidity at the time of application to the concreted conduit. Compounds can be added to the concrete to control the curing and setting up rates and other characteristics of these concretes.

The foregoing disclosure and description of the invention is illustrative and explanatory thereof, and various changes, shape and materials as well as in the details of the illustrated construction may be made within the scope of the appended claims without departing from the spirit of the invention.

I claim:

1. An apparatus for making conduit by working concrete into a conduit mat comprising;

(a) a base;

(b) a transmission means connected to said base;

(c) a power means drivingly connected to said transmission means;

(d) form means for shaping said conduit mat connected to said transmission means;

(e) feeder means drivingly connected to said transmission means for applying material on said form means to form a conduit mat of said material;

(f) advancing means connected to said transmission means for advancing said formed conduit mat from said form means;

(g) fastener means connected to said base for fastening said formed conduit mat together as said conduit mat is advanced;

(h) injection means connected to said base for injecting concrete on said conduit mat as said conduit mat is advanced;

(i) a first trowel means connected to said transmission means for working concrete on one side of said conduit mat as said conduit mat is advanced;

(j) a second trowel means connected to said base for working said concrete on the other side of said conduit mat as said conduit mat is advanced; and (k) curing means connected to said base for curing said concrete to form a concrete conduit.

2. The apparatus of claim 1 wherein said first trowel means is a mandrel smaller in diameter than said form means.

3. The apparatus of claim 2 further comprising a centering means connected to said base for centering said conduit mat about said first trowel means.

4. The apparatus of claim 3 wherein said centering means comprises roller means connected to said base for centering said conduit mat as it is advanced on said first trowel means.

5. The apparatus of claim 2 wherein said mandrel rotates for working said concrete into said conduit mat on one side.

6. The apparatus of claim 1 wherein said second trowel means comprises vibrating heads adjacent said injection means for working the concrete and smoothing heads connected to said base and positioned adjacent said injection means for finishing the surface of said conduit mat.

7. The apparatus of claim 6 wherein said first trowel means for working concrete is connected to said transmission for rotation.

8. The apparatus of claim 7 wherein said smoothing heads are mounted for rotation about said conduit mat.

9. The apparatus of claim 8 wherein said smoothing heads are mounted for rotation in a direction opposite the direction of rotation of said first trowel means.

10. The apparatus of claim 1 wherein said injection means are injections connected on said base to form a circumferential ring through which said conduit mat is passed for injecting concrete on said conduit mat as said conduit is advanced.

11. The apparatus of claim 1 wherein said form means is provided with a recess for said fastener means to operate therein during fastening said conduit mat together.

12. The apparatus of claim 1 wherein said fastener means is a stapler means and wherein said form means is provided with an anvil means for closing a staple means on said mat to fasten said mat together.

13. The apparatus of claim 5 further comprising said base connected to a mobile means for moving along as said concrete conduit is formed.

* * * * *